US005443120A

United States Patent [19]

Howell

[11] Patent Number: 5,443,120

[45] Date of Patent: Aug. 22, 1995

[54] METHOD FOR IMPROVING PRODUCTIVITY OF A WELL

[75] Inventor: David A. Howell, Midland, Tex.

[73] Assignee: Mobil Oil Corporation, Fairfax, Va.

[21] Appl. No.: 294,800

[22] Filed: Aug. 25, 1994

[51] Int. Cl.[6] ..... E21B 43/38

[52] U.S. Cl. ..... 166/265; 166/306; 166/313

[58] Field of Search ..... 166/265, 267, 305.1, 166/306, 313, 50

[56] References Cited

U.S. PATENT DOCUMENTS

| | | | |
|---|---|---|---|
| 3,167,125 | 1/1965 | Bryan | 166/306 |
| 3,195,633 | 7/1965 | Jacob | 166/306 |
| 3,363,692 | 1/1968 | Bishop | 166/306 |
| 4,296,810 | 10/1981 | Price | 166/265 |
| 4,429,740 | 2/1984 | Malinchak | 166/305.1 |
| 4,766,957 | 8/1988 | McIntyre | 166/265 |
| 5,335,732 | 8/1994 | McIntyre | 166/313 |
| 5,366,011 | 11/1994 | Jennings, Jr. | 166/265 |

OTHER PUBLICATIONS

"What's new in artificial lift", Lea and Winkler, World Oil, Mar., 1994, vol. 215 No. 3, p. 51.

"Downhole Injection Pump lowers cost of natural gas well-water disposal", Hart's Oil and Gas World, Apr., 1994 vol. 86 No. 4 p. 38.

*Primary Examiner*—Stephen J. Novosad

*Attorney, Agent, or Firm*—Alexander J. McKillop; George W. Hager, Jr.

[57] ABSTRACT

A method for improving the productivity of a well by separating and disposing of at least a portion of the water which is produced from a subterranean producing formation. The water is allowed to separate from the produced fluids under the influence of gravity while in the wellbore. The separated water is then disposed without removing it from the wellbore by flowing it into a subterranean disposal formation which has a pressure less than that of said producing formation. Preferably, the well is completed with an inclined wellbore which significantly aids in the gravity separation of the water from the produced fluids (e.g. hydrocarbons).

4 Claims, 5 Drawing Sheets

METHOD FOR IMPROVING PRODUCTIVITY OF A WELL

DESCRIPTION

1. Technical Field

The present invention relates to a method for improving the productivity of a well and in one of its aspects relates to a method for improving the productivity of a hydrocarbon producing well by separating at least a portion of the produced water from the other production fluids downhole in a well and then disposing of the water into a subterranean disposal formation without ever producing the separated water to the surface.

2. Background Art

In producing hydrocarbons (e.g. oil and/or gas) from subterranean formations, a substantial amount of water (e.g. fresh, brine, etc.) is routinely produced along with the desired hydrocarbons from the producing formation. As is universally recognized in the industry, this water creates several problems which adversely affect the productivity of a well and hence, the profitability of the well.

For example, typically all of the produced water must be produced to the surface along with the desired hydrocarbons. The water is substantially heavier than the other produced fluids thereby developing a hydrostatic head or pressure within the production tubing as the fluids are produced to the surface. This hydrostatic pressure applies a back-pressure on the producing formation which, in turn, directly impedes the flow of fluids into the wellbore. If this hydrostatic back-pressure caused by the water being produced to the surface can be reduced, then the productivity of the well will be inherently increased.

Further, substantially all of the produced water has be separated from the hydrocarbons after they reach the surface. This normally requires special equipment and relatively large storage capacities on the surface which, in turn, requires substantial capital outlays and maintenance. Still further, once separated, the water has to be disposed of in an ecologically acceptable manner which usually involves pumping the large volumes of water back into a subterranean disposal formation, which requires additional capital and maintenance.

Accordingly, it can easily be appreciated that the separation and disposal of water in a wellbore without having to produce that water to the surface with the desired production fluids will be highly beneficial to the productivity and the overall ecomonics for that well.

DISCLOSURE OF THE INVENTION

The present invention provides a method for improving the productivity of a well by separating and disposing of at least a portion of the water which is normally produced with the desired fluids (e.g. hydrocarbons) from a subterranean producing formation. Basically, the fluids are produced into the wellbore where at least a portion of the water will separate under the influence of gravity. This separated water is then disposed of without the separated volume of water ever being produced from the wellbore by flowing the separated water into a subterranean disposal formation which has a pressure less than that of said producing formation. Preferably, the well is completed with a wellbore which is inclined from vertical which significantly aids in the gravity separation of the water.

More specifically, the present invention provides a method for increasing or improving the productivity of a producing well (e.g. a hydrocarbon-producing well). Preferably, the well is completed with an inclined, cased wellbore. The casing is perforated adjacent to both the producing formation (e.g. hydrocarbon-producing formation) and a disposal formation (i.e. a formation which is permeable to water and which has a pressure lower than that of the producing formation). It should be recognized that both the producing formation and the disposal formation may be completed open-hole without varying from the present invention.

A string of production tubing is run into wellbore and packer or the like is set to isolate the wellbore above the producing formation. Produced fluids, which normally contains substantial amounts of water, are produced from the producing formation into the wellbore where gravity separation takes place between the lighter fluids (e.g. hydrocarbons such as natural gas, etc.) and the heavier water. The hydrocarbons (e.g. bubbles or molecules of gas, oil, etc.,) will migrate to the high side while the water drops or molecules will move towards the low side of the wellbore.

The separated water flows from the wellbore into the lower-pressured, disposal formation while the production fluids (the produced hydrocarbons and some remaining water) flow upward under differential pressure through the production tubing to the surface. The present invention includes different embodiments of well completions whereby the separated water may be disposed of into a disposal formation which may lie either below or above the producing formation.

While there will likely be some water still remaining in the production fluids when they reach the surface, the volume of water therein will be substantially reduced which, in turn, significantly reduces both (a) the hydrostatic back-pressure on the producing formation and (b) the water separation and handling problems at the surface. Accordingly, the productivity and hence, the profitability, of the well are substantially increased.

BRIEF DESCRIPTION OF THE DRAWINGS

The actual construction, operation, and the apparent advantages of the present invention will be better understood by referring to the drawings in which like numerals identify like parts and in which.

BEST MODE FOR CARRYING OUT THE INVENTION

Figure 1:
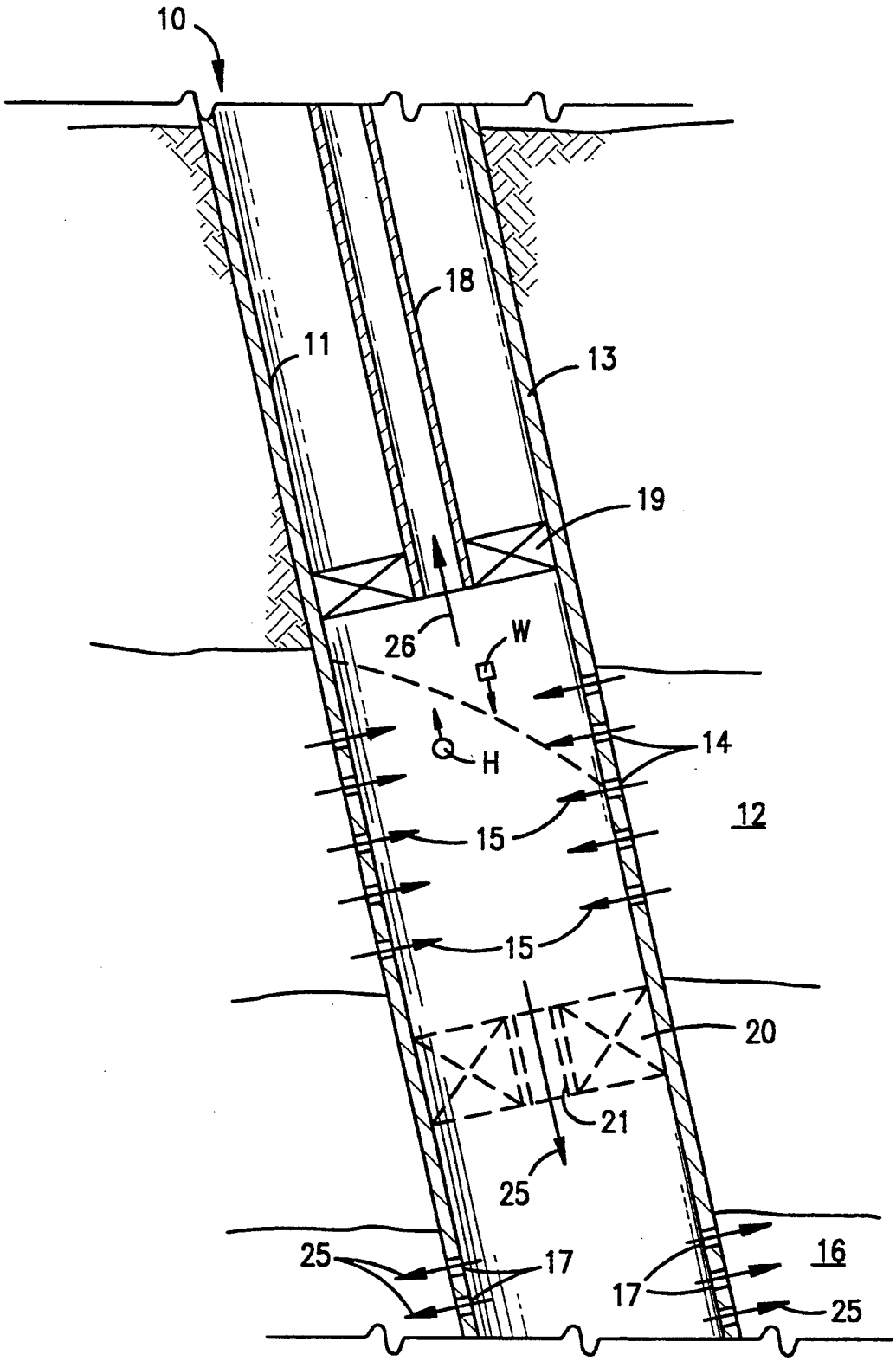
FIG. 1 is a sectional view of a single completion in the lower portion of an inclined wellbore used for separating and disposing of water in accordance with the present invention.

Referring more particularly to the drawings, FIG. 1 discloses a hydrocarbon-producing well 10 having a wellbore 11 which has been drilled and cased in accordance with conventional procedures. Wellbore 11 passes through several distinct subterranean formations which include hydrocarbon-producing formation 12 (e.g. a relatively high pressure, natural gas producing formation) . As will be understood, casing 13 is perforated to provide perforations 14 adjacent producing formation 12 to allow the produced fluids (arrows 15) to flow from formation 12 into wellbore 11. It should be recognized that in some instances, producing formation 12 could be completed open-hole (i.e. not cased).

As is typical in producing wells of this type, the produced fluids 15 will normally include substantial volumes of water (e.g. fresh, brine, etc. ) along with the hydrocarbons (e.g. natural gas). Normally, this water has to be produced to the surface along with the hydrocarbons. Unfortunately, the heavier water builds up a hydrostatic head within the wellbore as it is produced to the surface which, in turn, developes a back-pressure on producing formation 12 which impedes and adversely affects flow from the formation 12 (i.e. productivity of the well). Further, the water has to be separated from the hydrocarbons at the surface before the hydrocarbons can be pipelined or the like and the separated water has to be disposed of, usually by pumping it back into a subterranean formation through a disposal well.

In accordance with the present invention, well 10 is completed whereby a substantial volume of the produced water is separated from the hydrocarbons downhole in wellbore 11 and is disposed of into a subterranean formation without the separated volume of water ever being produced to the surface.

In carrying out the present invention, wellbore 11 is logged with standard techniques to locate a disposal formation 16 which is in communication with wellbore 11. "Disposal formation", as used herein, is meant to be any formation which is permeable to water and which has a pressure lower than that of the production formation. If the permeability of a selected disposal formation (e.g. loose, granular, etc.) is too great, it may be necessary to treat the deposal formation to reduce its permeability before the well is put on production. Several well-known techniques (consolidating, etc. ) are available in the art for such treatments. Once a disposal formation 16 is selected, casing 13 is further perforated to provide perforations 17 adjacent disposal formation 16. Again, although well 10 is illustrated as being cased through disposal formation 16, it should be understood that the disposal formation does not need to be cased and can be completed open-hole.

A string of production tubing 18 is run into wellbore 11 and packer 19 is set above the producing formation 12 to isolate the wellbore above the producing formation. With unrestricted flow between the producing formation 12 and disposal formation 16, the well is now ready to be put on production. However, if restricted flow is desired, a packer or plug (dotted lines 20 in FIG. 1) having a passage 21 therethrough is set in the wellbore 11 below the producing formation 12 before the tubing 18 and packer 19 are run into the wellbore.

Produced fluids 15 flow from producing formation 12, through perforations 14, and into wellbore 11. While the present invention is applicable to substantially vertical wellbores, it is preferred and is highly beneficial to complete at least that portion of wellbore 11 which passes through producing formation 12 at an angle to the vertical, i.e. an "inclined" wellbore. By inclining the wellbore, a much better gravity separation of fluids occurs within the wellbore.

As the produced fluids 15 flow into the wellbore, gravity separation between the lighter hydrocarbons (e.g. natural gas, etc.) and the heavier water begins to take place almost immediately. This gravity separation is enhanced by the inclination of the wellbore 11 at the point of entry of the fluids 15. The hydrocarbons (e.g. bubbles or molecules of gas, oil, etc., "H" in FIG. 1) will migrate to the high side while the water drops or molecules "W" will move towards the low side in wellbore 11. The water (arrow 25) will flow downward in wellbore 11 under the influence of gravity and through perforations 17 into the lower-pressured, disposal formation 16.

The production fluids (arrow 26) which are comprised of the produced hydrocarbons and some remaining water flow upward under differential pressure through tubing 18 to the surface. While there is still some water remaining in the production fluids, the volume of water is substantially reduced. This, in turn, significantly reduces both (a) the hydrostatic back-pressure on the producing formation 12 and (b) the water separation and handling problems at the surface. Accordingly, the productivity and hence, the profitability, of the well are substantially increased.

To better illustrate the advantages of the present invention, the following example is set forth. Recently, a gas producing well in West Texas was completed basically as shown in FIG. 1 and described above. The casing in the inclined wellbore was perforated adjacent a producing formation 12 at approximately 16,000 feet and an open-hole disposal formation 16 was identified at a depth of approximately 18,000 feet. The pressures of the producing formation 12 and the disposal formation were 5880 psi and 3590 psi, respectively. After the well was put on production, production logs showed that 1300 mcf of hydrocarbons (i.e. natural gas) and 800 barrels of water were being produced daily while 4200 barrels of water (84 percent of water produced) were being separated and disposed of downhole. Due to the strong water drive in the producing formation and the size and present level of depletion of the disposal formation, it is predicted that the present invention will aid in recovering an additional 1.8 billion cubic feet of gas before the operational life of the well is complete.

Figure 2:
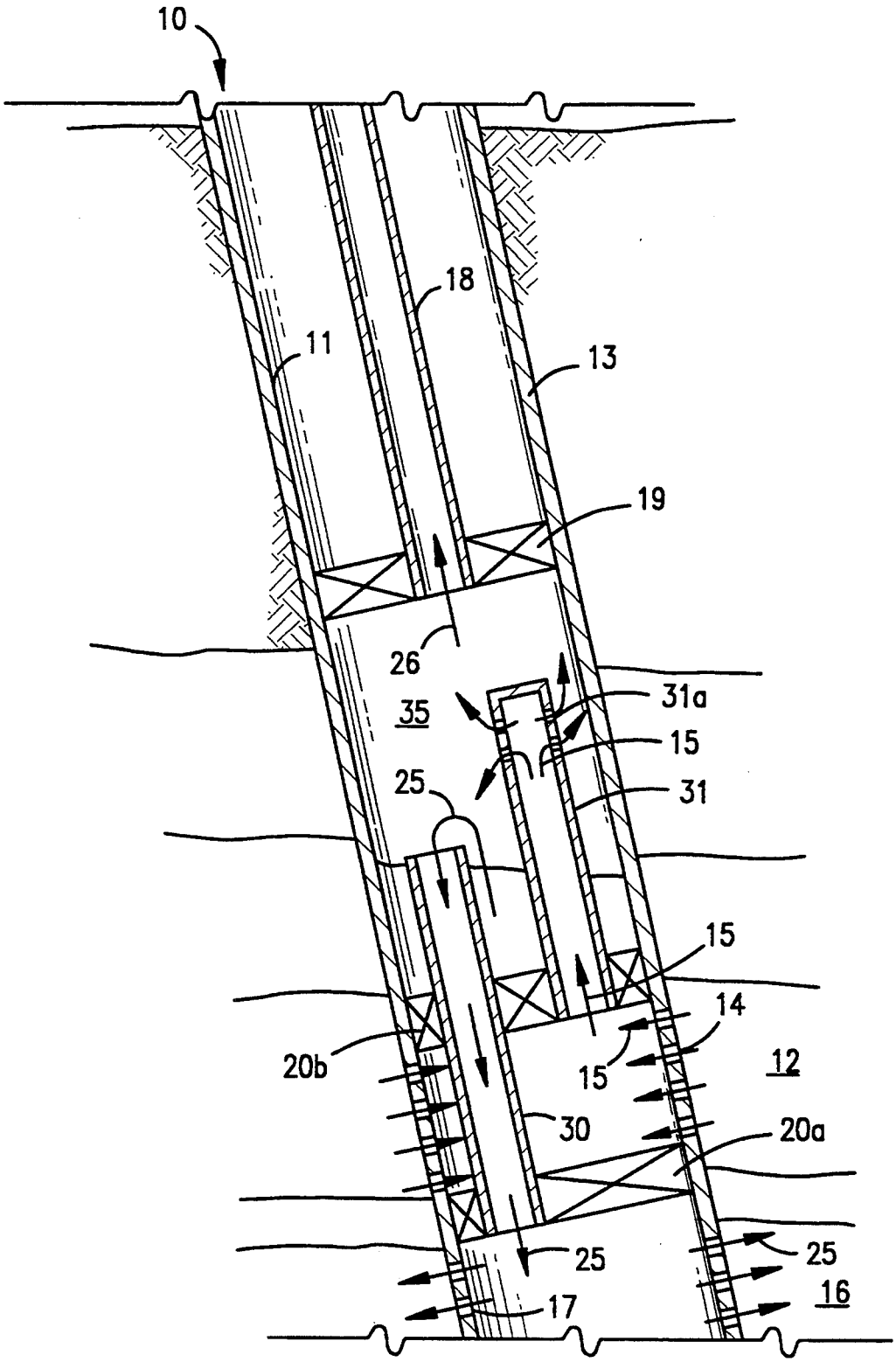
FIG. 2 is a sectional view of a special completion in the lower portion of an inclined wellbore used for separating and disposing of water into a disposal formation which lies below the production formation.
Figure 3:
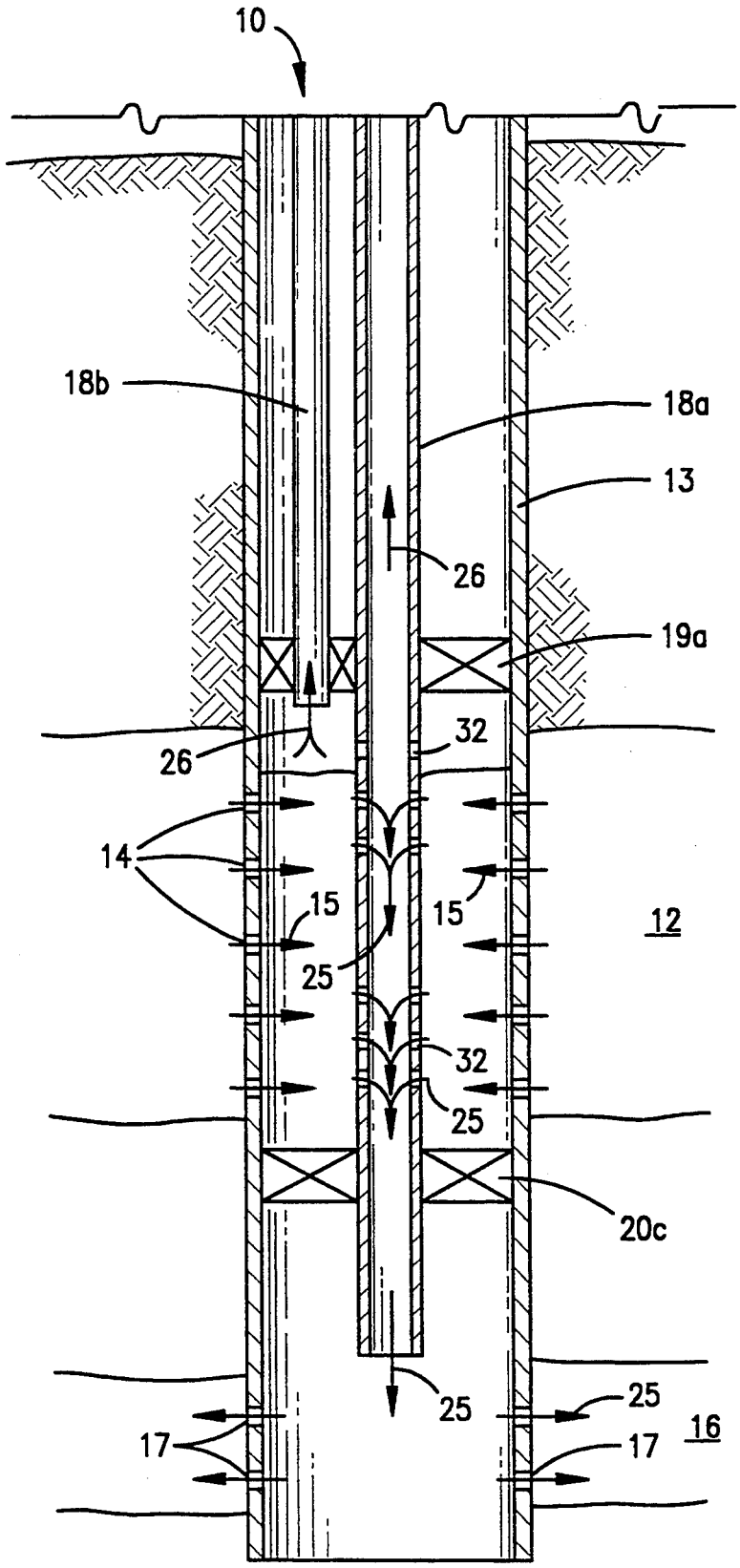
FIG. 3 is a sectional view of a dual completion in the lower portion of an inclined wellbore used for separating and disposing of water in accordance with the present invention.
Figure 4:
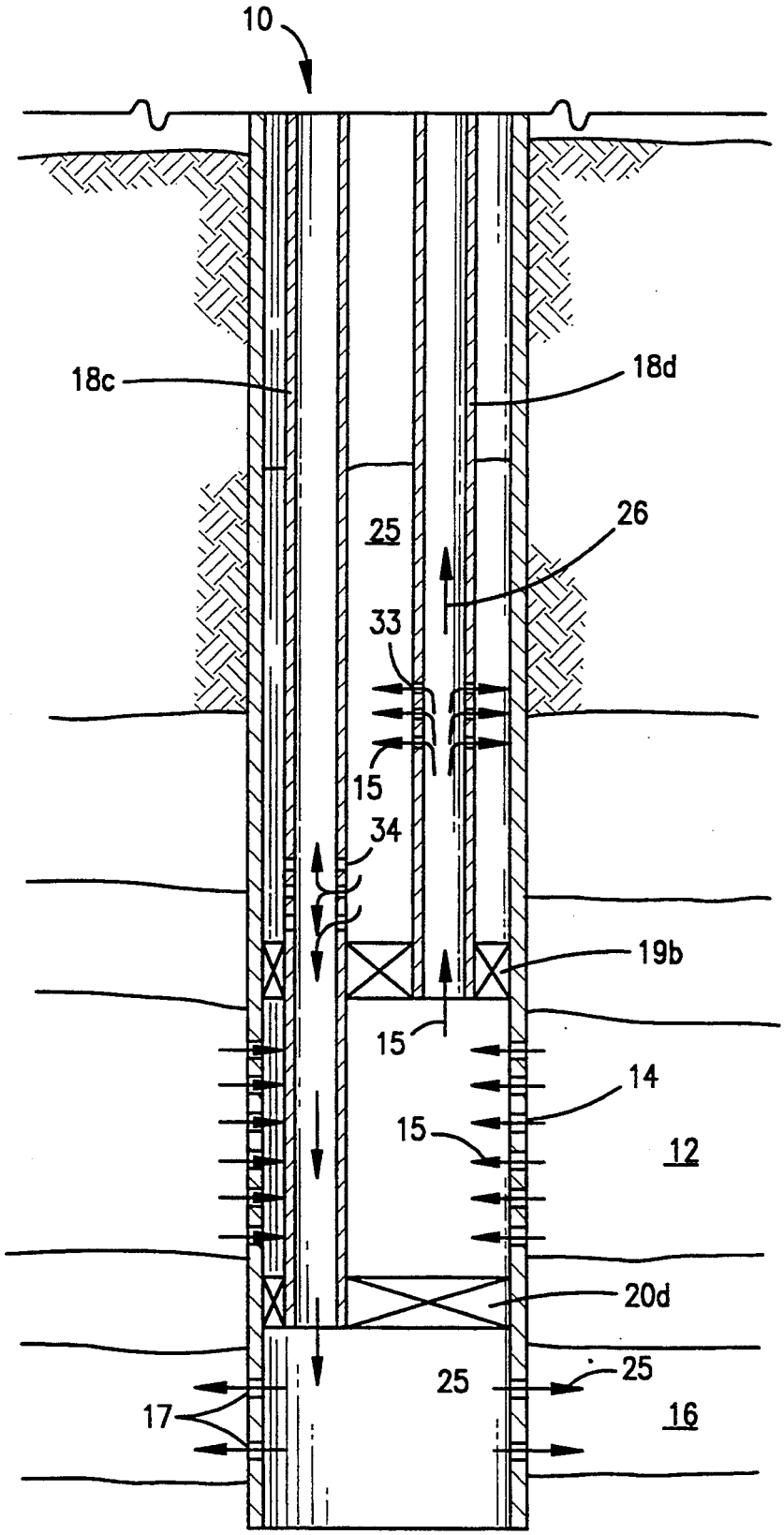
FIG. 4 is a sectional view of a special dual completion in the lower portion of an inclined wellbore used for separating and disposing of water in accordance with the present invention.

Referring now to FIGS. 2–4, embodiments of different completions are illustrated which can be used to carry out the present invention. In FIG. 2, inclined well 10 is cased and perforated adjacent producing formation 12 and disposal formation 16 as described above. Lower packer 20a and upper packer 20*b*, respectively, are set below and above perforations 14 to effectively isolate producing formation 12. A relatively short string of tubing 30 extends through both packers 20*a* and 20*b* to provide fluid communication between disposal formation 16 and the chamber 35 which is formed between upper packer 20*b* and packer 19 on production tubing 18. A second relatively short string of tubing 31 also extends through upper packer 20*b* to provide fluid communication between the producing formation 12 and the chamber 35.

In operation, the produced fluids 15 flow into wellbore 11 through perforations 14 and up into chamber 35 through tubing 31a in tubing 31 wherein the fluids 15 undergo gravity separation. Water 25 from fluids 15 will accumulate onto the top of upper packer 20*b* until its level reaches the top of tubing 30, after which water 25 will flow downward through tubing 30 into the disposal formation 16. Production fluids 25 (i.e. hydrocarbons and the remaining water) will flow upward to the surface through tubing 18.

FIG. 3 illustrates a well completion which is similar to a conventional dual completed well. Again, while well 10 in both FIGS. 3 and 4 are illustrated as having substantially vertical wellbores 11, it should be understood that wellbore 11 is preferably inclined from the vertical. In FIG. 3, wellbore 11 is cased and perforated adjacent producing formation 12 and disposal formation 16 as before. A first string of production tubing 18*a* is lowered and lower packer 20*c* and upper packer 19*a* are set to effectively isolate producing formation 12. Tubing 18*a* extends through lower packer 20*c* and has a plurality of openings 32 adjacent isolated producing formation 12. A second string of production tubing 18*b* extends from the surface through upper packer 19*a*.

In operation, produced fluids 15 flow into the wellbore through perforations 14. After gravity separation of the produced fluids, water 25 will flow through openings 32 in tubing 18*a* downwardly into disposal formation 16 and the production fluids 26 will flow upward through tubing string 18*b*. Some of produced fluids 15 may flow through openings 32 into tubing 18*a* but gravity separation will also occur within the tubing with the water 25 flowing downward and the production fluids flowing upward therein.

FIG. 4 illustrates still another completion which can be used to carry out the invention. Again, well 10 is cased and perforated and upper 19*b* and lower 20*d* packers are used to isolate the production formation 12 as before. A first string of tubing 18*c* having openings 34 therein extends from the surface through the lower packer 20*d*. A second string of tubing 18*d* having opening 33 therein extends from the surface through the upper packer 19*b*.

In operation, the produced fluids 15 flow through perforations 14 into the wellbore between packers 19*b* and 20*d*, up through second tubing string 18*d*, and out openings 33 onto the top of upper packer 19*b* where gravity separation takes place. Water 25, upon accumulating onto packer 19*b*, will flow through openings 34, down tubing 18*c*, and into disposal formation 16.

Figure 5:
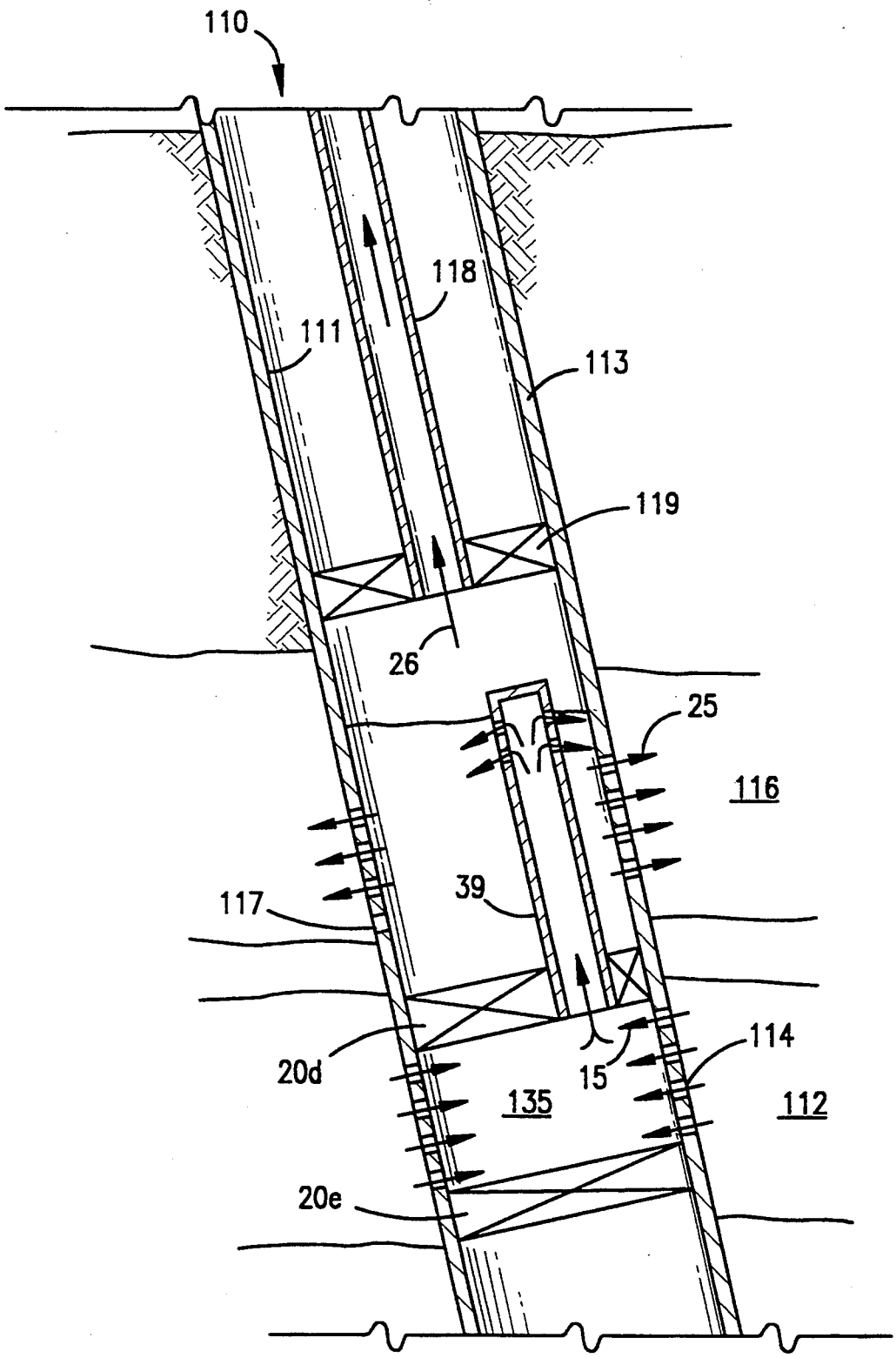
FIG. 5 is a sectional view of a special completion in the lower portion of an inclined wellbore used for separating and disposing of water into a disposal formation which lies above the production formation in accordance with the present invention.

The completion illustrated in FIG. 5 is designed to separate and dispose of water downhole wherein the disposal formation 116 lies above the producing formation 112. Well 110 is cased and perforated adjacent both the producing formation 112 and disposal formation 116. Upper packer 20*d* and lower plug 20*e* are set to isolate producing formation 112 and packer 119 on tubing string 118 is set to form a chamber 135 between packer 20*d* and packer 114. A relatively short string of tubing 39 extends into chamber 135 through lower packer 20*d*.

In operation, produced fluids 15 flow through perforations 114, up short tubing 39, and into chamber 135 where gravity separation takes place. The water 25 flows through perforations 117 into disposal formation 116. The production fluids flow upward to the surface through production tubing 118.

What is claimed is:

1. A downhole method for separating and disposing of water from fluids produced from a subterranean producing formation into a wellbore, said method comprising:

completing said wellbore wherein the portion of said wellbore which lies adjacent said production formation is inclined from the vertical;

isolating said portion of said wellbore which lies adjacent said producing formation;

producing produced fluids from said producing formation into said isolated, inclined portion of said wellbore, said produced fluids including water;

allowing at least a portion of said water from said produced fluids to separate from said produced fluids by gravity while said produced fluids are in said isolated, inclined portion of said wellbore; and disposing of said separated water into a subterranean disposal formation without the separated volume of water ever being produced from said wellbore, said disposal formation having a pressure less than that of said producing formation.

2. The separating and disposal method of claim 1 including:

producing the produced fluids to the surface after said at least a portion of said water has been separated therefrom.

3. The separating and disposal method of claim 2 wherein said disposal formation is below said production formation.

4. The separating and disposal method of claim 2 wherein said disposal formation is above said production formation.

* * * * *